US007063608B2

(12) United States Patent
Yoshida et al.

(10) Patent No.: US 7,063,608 B2
(45) Date of Patent: Jun. 20, 2006

(54) GRINDING WHEEL HAVING CORE BODY COATED WITH IMPERMEABLE COATING

(75) Inventors: Kazumasa Yoshida, Niwa-gun (JP); Kensei Shimura, Haguri-gun (JP); Tomoharu Kondo, Nagoya (JP)

(73) Assignees: Noritake Co., Limited, Nagoya (JP); Noritake Super Abrasive Co., Ltd., Fukuoka (JP)

( * ) Notice: Subject to any disclaimer, the term of this patent is extended or adjusted under 35 U.S.C. 154(b) by 0 days.

(21) Appl. No.: 10/661,631

(22) Filed: Sep. 15, 2003

(65) Prior Publication Data

US 2004/0082290 A1 Apr. 29, 2004

(30) Foreign Application Priority Data

Oct. 24, 2002 (JP) ..... 2002-310182

(51) Int. Cl.
*B24B 33/00* (2006.01)

(52) U.S. Cl. ..... 451/541; 451/546; 451/547

(58) Field of Classification Search ..... 451/540, 451/541, 544, 546, 547, 543
See application file for complete search history.

(56) References Cited

U.S. PATENT DOCUMENTS 1,616,531 A * 2/1927 King ..... 451/544
1,997,952 A * 4/1935 Snelling ..... 312/140.1
2,036,903 A * 4/1936 Webster ..... 51/293
2,540,112 A * 2/1951 Goepfert et al. ..... 451/541
2,643,945 A * 6/1953 Buckner ..... 51/297
2,735,249 A * 2/1956 Martin et al. ..... 451/450
2,763,105 A * 9/1956 Feeley ..... 451/544
3,115,401 A * 12/1963 Downing et al. ..... 51/293
3,146,560 A * 9/1964 Hurst ..... 451/527
3,431,687 A * 3/1969 Fischer et al. ..... 451/541
3,487,589 A * 1/1970 Binkley ..... 451/546
3,785,094 A * 1/1974 Holzhauer ..... 451/532
4,016,620 A * 4/1977 Powers ..... 15/104.061
4,446,657 A * 5/1984 Asaeda et al. ..... 451/541
4,910,924 A * 3/1990 Bouchard et al. ..... 451/548
4,989,375 A * 2/1991 Henmi et al. ..... 451/550
5,496,208 A * 3/1996 Neff ..... 451/541
6,102,789 A * 8/2000 Ramanath et al. ..... 451/541
6,450,870 B1 * 9/2002 Ito ..... 451/542
6,827,641 B1 * 12/2004 Yoshida et al. ..... 451/544

FOREIGN PATENT DOCUMENTS

JP A 5-285848 11/1993

* cited by examiner

*Primary Examiner*—M. Rachuba
(74) *Attorney, Agent, or Firm*—Oliff & Berridge, PLC

(57) ABSTRACT

A grinding wheel including: (a) an annular core body which includes a multiplicity of aggregate particles and a resin bond that holds said aggregate particles together; (b) an abrasive layer which is disposed radially outwardly of said annular core body and which includes a multiplicity of abrasive grains and a vitrified bond that holds said abrasive grains together; and (c) an impermeable coating which is formed of a synthetic resin, and which is disposed on said annular core body.

8 Claims, 3 Drawing Sheets

PRIOR ART

GRINDING WHEEL HAVING CORE BODY COATED WITH IMPERMEABLE COATING

BACKGROUND

The present invention relates in general to improvements in a vitrified grinding wheel including an annular core body which is constituted principally by a synthetic resin, and an abrasive layer which has a vitrified abrasive structure and which is disposed radially outwardly of the annular core body.

There is known a vitrified grinding wheel having in its center a mounting hole which is to be fitted onto a wheel spindle of a grinding machine, and including an annular core body and an abrasive layer which is disposed radially outwardly of the annular core body and which includes a multiplicity of abrasive grains held together by a vitrified bond. Commonly, the annular core body is provided by a carbon steel, an aluminum alloy or a synthetic resin, while the abrasive layer is provided by standard abrasive grains (such as silicon carbide grains and alumina grains) or super abrasive grains (such as diamond grains and CBN grains). As an example of such a vitrified grinding wheel, there is a segment-chip-type grinding wheel in which the abrasive layer is provided by a plurality of abrasive segment chips bonded to an outer circumferential surface of the annular core body.

When a cylindrical workpiece requires to be finished at its surface by the grinding wheel such that the surface of the hard coating is smoothed to have a roughness Ra (arithmetical mean deviation of profile), for example, of 0.2–0.5 μm, at least one of the cylindrical workpiece and the grinding wheel is axially moved relative to the other, with the workpiece and the grinding wheel being both rotated about their respective axes which are held in parallel with each other. In this instance, there is a case where the grinding wheel suffers from its self-oscillation induced, for example, by run out (eccentricity), out of balance, or out of round of the grinding wheel itself, so that chatter marks such as wavy line and spirals are undesirably formed on the surface. Such undesirable marks are not notable in a measurement for the surface roughness, namely, do not affect the measured value of the surface roughness. However, where the ground workpiece is a roll used for a rolling mill, such marks are inconvenient, because the marks on the surface of the roll are likely to be transferred onto a surface of a plate or sheet rolled by the roll, or are likely to cause an oscillation of the roll, resulting in a reduced yield rate in the operation of the rolling mill. The tendency of the self-oscillation of the grinding wheel is increased, particularly, where the roll is formed of a hard material such as a ceramic material and a high-speed tool steel, and is ground by the abrasive layer provided by the super abrasive grains such as diamond grains and CBN grains.

In view of the above-described problem, there is proposed a vitrified grinding wheel capable of preventing the formation of the chatter marks in a grinding operation, as disclosed in JP-A-H05-285848 (publication of unexamined Japanese Patent Application laid open in 1993). The annular core body of the disclosed grinding wheel has an elastic modulus of 1500–5000 kgf/mm$^2$ as measured in a radial direction of the annular core body, so that the core body having the elasticity serves to absorb oscillation of the grinding surface of the grinding wheel which could be induced by run out (eccentricity), out of balance, or out of round of the grinding wheel. Therefore, the formation of the chatter marks on the ground surface in the grinding operation is advantageously prevented.

However, where the annular core body of the vitrified grinding wheel is provided by a resinoid structure in which aggregate particles such as silicon carbide and alumina are held together by a resin bond, there is a problem that abrasive segment chips 50 (cooperating with each other to constitute an abrasive layer) have cracks 52, as shown in FIG. 5, after its long-time use or storage. An extensive study by the present inventor revealed that the problematic cracks are caused by change in the volume of the annular core body which is subjected to a cutting fluid used in a grinding operation or moisture contained in the atmosphere.

SUMMARY

The present invention was made in view of the background prior art discussed above. It is therefore an object of the present invention to provide a grinding wheel having an abrasive layer which does not suffer from cracking even after its long-time use or storage. This object of the invention may be achieved according to any one of the first through eighth aspects of the invention which are described below.

The first aspect of this invention provides a grinding wheel comprising: (a) an annular core body which includes a multiplicity of aggregate particles and a resin bond that holds the aggregate particles together; (b) an abrasive layer which is disposed radially outwardly of the annular core body and which includes a multiplicity of abrasive grains and a vitrified bond that holds the abrasive grains together; and (c) an impermeable coating which is formed of a synthetic resin, and which is disposed on the annular core body.

In the grinding wheel constructed according to the first aspect of the invention, the impermeable coating prevents the annular core body from being exposed to a cutting fluid or moisture, whereby its volume change is advantageously avoided. In this manner, this grinding wheel is free from cracking of the abrasive layer even after its long-time use or storage.

According to the second aspect of the invention, in the grinding wheel defined in the first aspect of the invention, the annular core body further includes at least one sheet of glass fabric each of which is provided by a multiplicity of glass yarns and each of which is embedded in the annular core body and extends perpendicularly to an axial direction of the annular core body.

In the grinding wheel construed according to the second aspect of the invention, it is possible to minimize a volume expansion of the annular core body due to heat and centrifugal force acting on the core body in a grinding operation, so that cracking in the abrasive layer surrounding the core body is advantageously avoided in spite of a difference in coefficient of thermal expansion between the annular core body and the abrasive layer.

According to the third aspect of the invention, in the grinding wheel defined in the second aspect of the invention, the above-described at least one sheet of glass fabric consists of a plurality of sheets of glass fabric which are arranged in the axial direction of the annular core body.

According to the fourth aspect of the invention, in the grinding wheel defined in any one of the first through third aspects of the invention, the abrasive layer is provided by a plurality of abrasive segment chips which are arranged in a circumferential direction of the annular core body and which are fixed to an outer circumferential surface of the annular core body.

According to the fifth aspect of the invention, in the grinding wheel defined in the fourth aspect of the invention, the plurality of abrasive segment chips includes at least one pair of segment chips having respective circumferential end faces which are circumferentially opposed to each other with a predetermined amount of gap therebetween and which are non-parallel with respect to an axial direction of the annular core body.

In the grinding wheel constructed according to the fifth aspect of the invention, owing to the predetermined amount of gap between each of the above-described at least one pair of segment chips, cracking of the abrasive layer is reliably prevented even if the volume of the core body is slightly changed due to thermal expansion during a grinding operation. Further, owing to the arrangement in which the circumferential end faces of the adjacent segment chips opposed to each other with the predetermined amount of gap are inclined or non-parallel with respect to the axial direction, the formation of chatter marks on the ground surface of the workpiece is advantageously prevented.

According to the sixth aspect of the invention, in the grinding wheel defined in any one of the first through fifth aspects of the invention, the annular core body is covered over an entirety thereof with the impermeable coating, so that a portion of the impermeable coating disposed on an outer circumferential surface of the annular core body is interposed between the annular core body and the abrasive layer.

According to the seventh aspect of the invention, in the grinding wheel defined in any one of the first through sixth aspects of the invention, the impermeable coating is formed of an epoxy resin.

According to the eighth aspect of the invention, in the grinding wheel defined in any one of the first through sixth aspects of the invention, the impermeable coating is formed of a phenol resin.

BRIEF DESCRIPTION OF THE DRAWINGS

The above and other objects, features, advantages and technical and industrial significance of this invention will be better understood by reading the following detailed description of the presently preferred embodiments of the invention, when considered in connection with the accompanying drawings, in which.

DETAILED DESCRIPTION OF PREFERRED EMBODIMENTS

The preferred embodiment of the present invention will be described in detail by reference to the accompanying drawings. It is to be understood, however, that FIGS. 1–5 do not necessarily show various parts or elements, with exact representation of ratios of their dimensions.

Figure 1A:
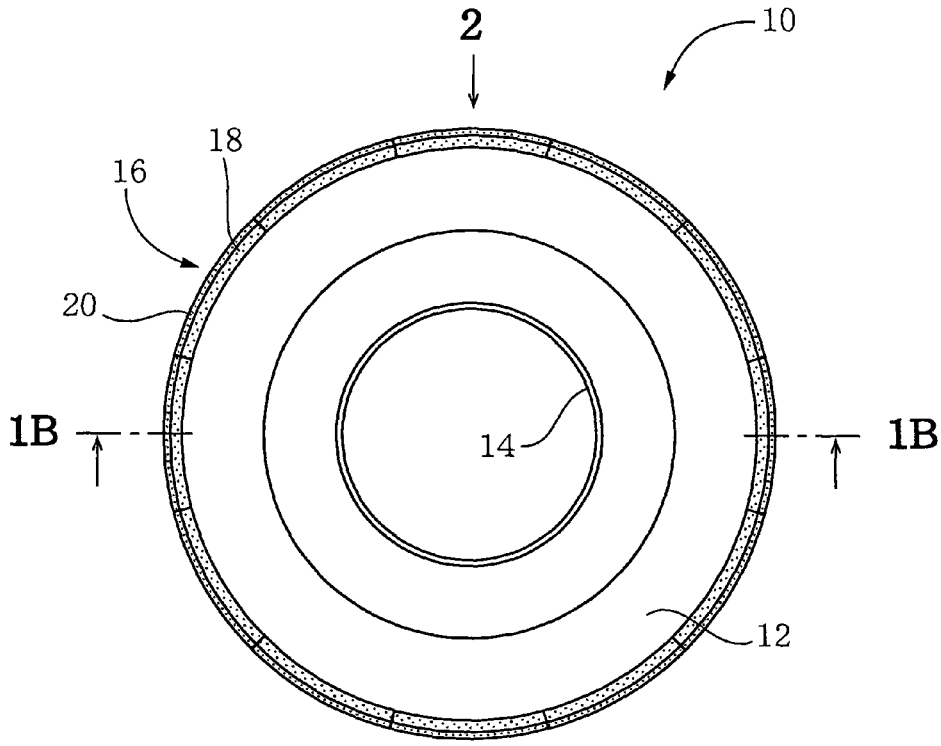
FIG. 1A is a plan view of a vitrified grinding wheel constructed according to one embodiment of the invention.
Figure 1B:
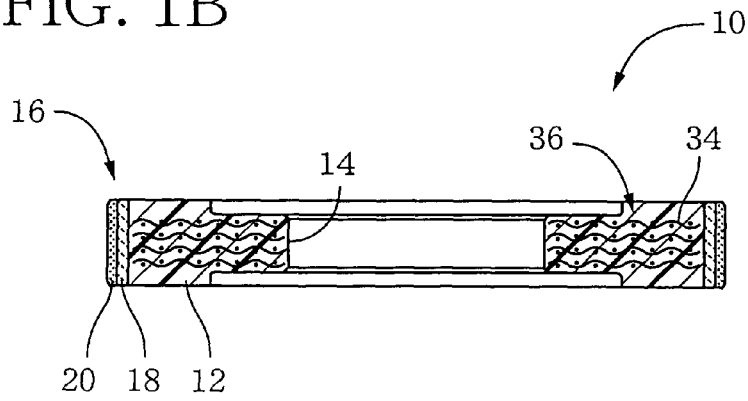
FIG. 1B is a cross sectional view taken along line 1B—1B of FIG. 1A.

FIGS. 1A and 1B show a vitrified grinding wheel in the form of a segment-chip-type grinding wheel 10 which is constructed according to an embodiment of this invention. FIG. 1A is a plan view of the grinding wheel 10 as seen in a direction perpendicular to its axial end face, while FIG. 1B is a cross sectional view taken along line 1B—1B of FIG. 1A. As is apparent from FIGS. 1A and 1B, the grinding wheel 10 includes: an annular core body 12 which has a central mounting hole 14 formed therethrough; and a plurality of part-cylindrical or arcuate abrasive segment chips 16 which are bonded to an outer circumferential surface of the annular core body 12. In the present embodiment, the grinding wheel 10 has an outside diameter of 660 mm, an inside diameter (diameter of the mounting hole 14) of 305 mm and an axial length of 100 mm. This grinding wheel 10 is installed on a grinding machine, by introducing a wheel spindle of the machine into the mounting hole 14.

Figure 2:
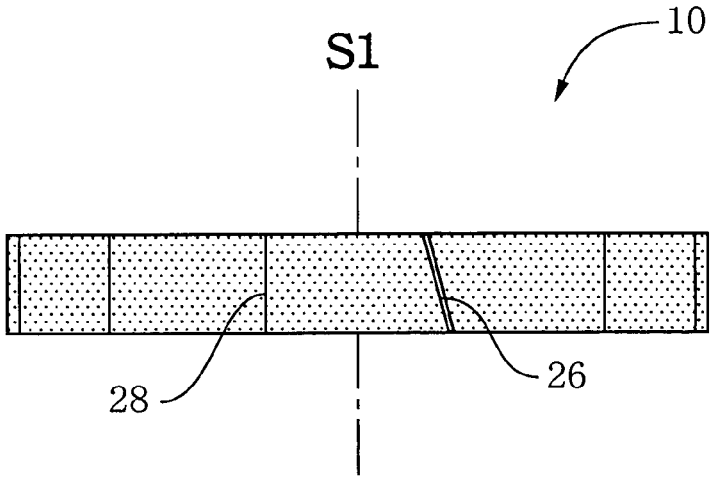
FIG. 2 is a side view of the grinding wheel as seen in a direction indicated by arrow 2 in FIG. 1A.
Figure 3:
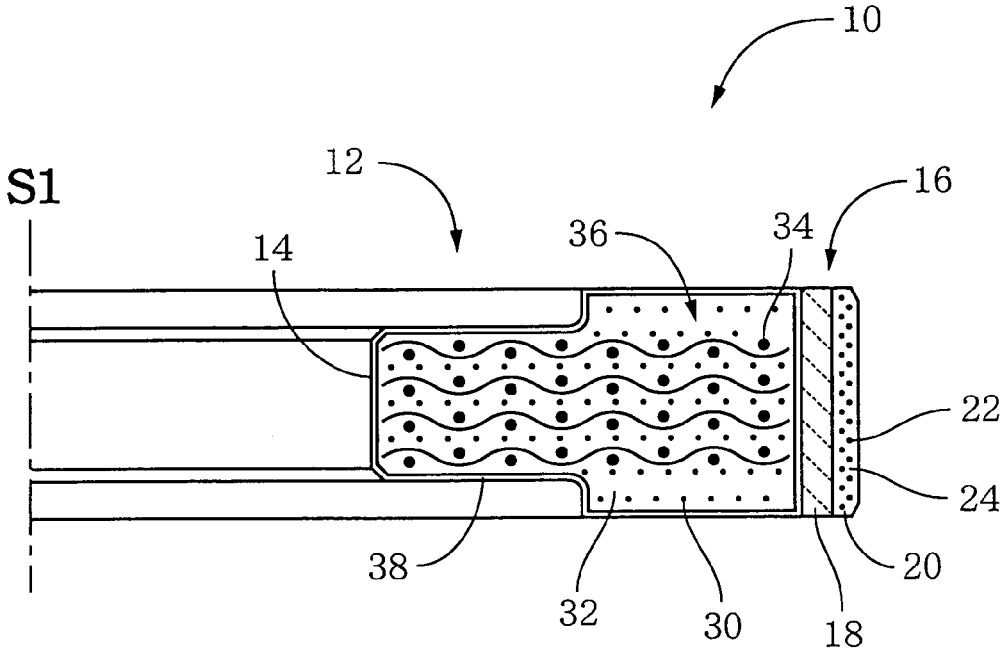
FIG. 3 is an enlarged view showing a part of the cross sectional view of FIG. 1B.

Each of the arcuate abrasive segment chips 16 has radially outer and inner surfaces in the form of arcuate surfaces which lie on respective circles having a common center at the axis S1 of the core body 12 (see FIG. 2). Each of the arcuate abrasive segment chips 16 has a radially inner layer in the form of a base layer 18 which is bonded to an outer circumferential surface (cylindrical surface) of the core body 12, and a radially outer layer in the form of an abrasive layer 20 which is disposed radially outwardly of the base layer 18. The abrasive layer 20 is provided by a vitrified abrasive structure in which a multiplicity of abrasive grains 22 are held together by a vitrified bond 24, as shown in FIG. 3, wherein each of the abrasive grains 22 consists of a standard abrasive grain (such as silicon carbide and fused alumina) or a super abrasive grain (such as diamond grains and CBN grains). This vitrified abrasive structure is a porous abrasive structure having a network of continuous pores or a multiplicity of pores independent of each other. In a grinding operation with the present grinding wheel 10, the abrasive layer 20 of each segment chip 16 is brought at its outer surface into contact with a workpiece while the grinding wheel 10 and the workpiece are both rotated about their respective axes, whereby the workpiece is ground by the outer surface of the abrasive layer 20 serving as a grinding surface.

FIG. 2 is a side view of the grinding wheel as seen in a direction indicated by the arrow 2 in FIG. 1A. The plurality of abrasive segment chips 16 includes at least one adjacent pair of segment chips having respective circumferential end faces which are circumferentially opposed to each other with a predetermined amount of gap 26 therebetween and which are non-parallel with respect to the axis S1 of the annular core body 12. The predetermined amount of the gap 26 may be, for example, about 50–100 μm as measured in a circumferential direction of the annular core body 12. In the present embodiment, there are a total of four, five, six, seven or eight gaps 26 in the grinding surface of the grinding wheel 10. The non-parallel circumferential end faces of the chips 16 are inclined by about 10°, with respect to the other circumferential end faces of the chips which are parallel with respect to the axis S1 of the annular core body 12. Each adjacent pair of the parallel circumferential end faces of the chips 16 are held in contact with each other or bonded to each other at a joint which is denoted by the reference numeral 28 in FIG. 2.

The annular core body 12 is constituted by a known resinoid abrasive structure including a multiplicity of aggregate particles 30 in the form of standard abrasive grains each provided by silicon carbide grains or fused alumina grains, and a resin bond 32 which is provided by phenol or epoxy resin and which holds the aggregate particles 30 together. Like the vitrified abrasive structure of the abrasive layer 20, the resinoid structure of the core body 12 is a porous abrasive structure having a network of continuous pores or a multiplicity of pores independent of each other. In the present embodiment, the annular core body 12 has an outside diameter of 646 mm, an inside diameter (diameter of the mounting hole 14) of 305 mm and an axial length of 100 mm.

As shown in FIGS. 1B and 3, the annular core body 12 includes four sheets of woven glass fabrics 36 which are embedded in the core body 12 and extend perpendicularly to the axis S1 of the core body 12. The four sheets of glass fabrics 36 are substantially equally spaced apart from each other in the axial direction of the core body 12. Each of the glass fabrics 36 is composed of a multiplicity of glass strands or yarns 34 each provided by a number of fibers twisted together and having a predetermined diameter. Described more specifically, the glass yarns 34 are arranged with a density of four yarns per 25 mm length, and are woven into the glass fabric 36 in a so-called "leno weave", "basket weave" or "plain weave" arrangement. Owing to the provision of the glass fabrics 36 in the annular core body 12, the core body 12 is given a coefficient of thermal expansion of about $7.2\times10^{-6}$, which is remarkably smaller than a coefficient of thermal expansion of a standard resinoid abrasive structure that is about $10.2\times10^{-6}$. Since a coefficient of thermal expansion of a standard vitrified abrasive structure is about $4.8\times10^{-6}$, the coefficient of thermal expansion of the core body 12 of the present grinding wheel 10 is closer to a coefficient of thermal expansion of the abrasive segment chips 16, as compared with the coefficient of thermal expansion of the standard resinoid abrasive structure.

FIG. 3 is an enlarged view showing a part of the cross sectional view of FIG. 1B. As shown in FIG. 3, an impermeable coating 38 formed of a synthetic resin is provided to cover an entirety of the annular core body 12. This impermeable coating 38 exhibits an excellent waterproof property as long as the grinding wheel 10 is used with its rotation at a peripheral velocity of about 30–80 m/s (as measured at the grinding surface). The formation of the impermeable coating 38 is made by implementing an applying step of applying two-pack epoxy resin (two-liquid mixture type epoxy resin) three times or so, onto a surface of the core body 12 with a suitable brush such that the core body 12 is impregnated with about 7% by weight of the epoxy resin per total weight of the core body 12, and a curing step of hardening or curing the epoxy resin at a temperature of about 50° C. during about 12 hours. Owing to the impermeable coating 38 covering the core body 12, the cutting fluid is prevented from entering the pores of the resinoid abrasive structure of the core body 12. While the epoxy resin penetrates about 10–20 mm into the core body 12 in the present embodiment, the amount of the penetration of the epoxy resin varies depending upon various factors such as characteristics of the epoxy resin and dimensions and shapes of the pores of the resinoid abrasive structure of the core body 12. A preferable amount of the penetration of the epoxy resin is 0.5–30 mm. A further preferable amount of the penetration of the epoxy resin is 1–20 mm. A still further preferable amount of the penetration of the epoxy resin is 2–15 mm.

It is noted that the epoxy resin giving the impermeable coating 38 may contain an inorganic filler in the form of solid particles or hollow (inside vacancy) particles, for thereby reducing the amount of the penetration of the epoxy resin. The reduction in the penetration amount of the epoxy resin is effective to save the epoxy resin as a material and also minimize a risk of deterioration of balance of the grinding wheel 10. It is also noted that the impermeable coating 38 may consist of two layers, one of which is formed of an epoxy resin having a relatively high content of the inorganic filler and the other of which is formed of an epoxy resin having a relatively low content of the inorganic filler. To this end, the above-described applying step may include a first step of applying the epoxy resin having the relatively high content of the inorganic filler, and a second step of applying the epoxy resin having the relatively low content of the inorganic filler. With implementations of the first and second steps in this order of description, a lower one of the two layers is formed of the epoxy resin having the relatively high content of the inorganic filler, and a upper one of the two layers id formed of the epoxy resin having the relatively low content of the inorganic filler.

Figure 4:
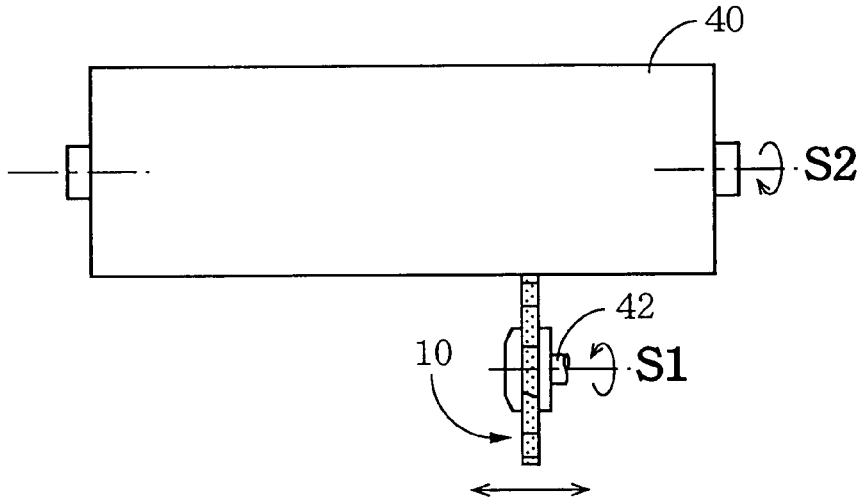
FIG. 4 is a view illustrating a grinding operation in which the grinding wheel of FIG. 1A is used to grind a cylindrical workpiece.
Figure 5:
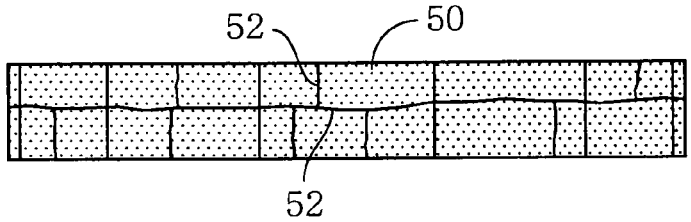
FIG. 5 is a view showing a conventional vitrified grinding wheel suffering from cracks in its abrasive layer.

FIG. 4 is a view illustrating a grinding operation in which the grinding wheel 10 is used to grind a cylindrical workpiece 40 in the form of a roll that is to be used in a rolling-mill stand for a hot or cold rolling operation. It is common that the roll requires to be periodically ground at its outer circumferential surface in the interest of maintaining accuracy and quality of a product rolled in the rolling operation. In the grinding operation, the grinding wheel 10 is mounted on the wheel spindle 42 of a grinding machine (not shown) such that the axis S1 of the wheel 10 is brought into parallel with an axis S2 of the workpiece 40. One of the grinding wheel 10 and the workpiece 40 is moved relative to the other in the axial direction of the workpiece 40, with the grinding wheel 10 and the workpiece 40 being both rotated about their respective axes. Since the annular core body 12 is constituted by the resinoid abrasive structure, the grinding wheel 10 exhibits an excellent elasticity against a force acting on the wheel 10 in its radial direction. It is therefore advantageous to use the present grinding wheel 10 in the grinding operation in which the roll has to be ground with relatively high degrees of dimensional accuracy and configuration accuracy.

A test was conducted by the present inventor, for verifying a technical effect provided by the present invention. The test was initiated by preparing four rectangular sample pieces each of which has a length of 100 mm, a width of 10 mm and a thickness of 10 mm, and each of which is provided by a resinoid abrasive structure having 50% by volume of GC abrasive grains, 24% by volume of phenol resin and 26% by volume of pores. Then, the two-pack epoxy resin was applied onto surfaces of two of the four sample pieces three times or so, by using a suitable brush. The applied epoxy resin was cured at a temperature of about 50° C. during about 12 hours, whereby the impermeable coating is formed on the surfaces of the two sample pieces. The four sample pieces, consisting of the two coated sample pieces and the two non-coated sample pieces, were left at a normal temperature in a room or were left in water. After a lapse of several days, a swelling or expansion rate (%) in each sample piece was measured. Results of the measurements are indicated in the following TABLE. As is apparent from the TABLE, the coated sample pieces exhibited a lower expansion rate than that of the non-coated sample pieces either in the room or in water. It is noted that a cross section of each of the coated sample pieces was observed after the test. According to the observation, the amount of the penetration of the epoxy resin into each of the pieces was about 2 mm.

TABLE

| | Left at normal temperature for 6 days | Left at normal temperature for 30 days | Left in water For 6 days |
|---|---|---|---|
| Non-coated sample pieces | 0.030% | 0.050% | 0.120% |
| Coated sample pieces | 0.025% | 0.030% | 0.020% |

In the grinding wheel 10 constructed according to the present embodiment of the invention, the impermeable coating 38 prevents the annular core body 12 from being exposed to a cutting fluid or moisture, whereby its volume change is advantageously avoided. In this manner, this grinding wheel 10 is free from cracking of the abrasive layer even after long-time use or storage.

Further, in the present grinding wheel 10 in which the glass fabrics 36 (each composed of the multiplicity of glass yarns 34) are embedded in the annular core body 12 and extend perpendicularly to the axial direction of the core body 12, it is possible to minimize the volume expansion of the annular core body 12 due to heat and centrifugal force acting on the core body 12 in a grinding operation, so that cracking of the abrasive layer 20 surrounding the core body 12 is advantageously avoided in spite of a difference in coefficient of thermal expansion between the annular core body 12 and the abrasive layer 20.

Still further, in the present grinding wheel 10, owing to the presence of the gaps 26 between the abrasive segment chips 16, cracking of the segment chips 16 is reliably prevented even if the volume of the core body 12 is slightly changed due to its thermal expansion during a grinding operation. Further, owing to the arrangement in which each of the gaps 26 extends in a direction inclined or non-parallel with respect to the axis S1 of the core body 12, the formation of chatter marks on the ground surface of the workpiece is advantageously prevented.

While the presently preferred embodiment of the invention has been described above with a certain degree of particularity, by reference to the accompanying drawings, it is to be understood that the invention is not limited to the details of the illustrated embodiment, but may be otherwise embodied.

For instance, the impermeable coating 38 is formed by curing a two-pack epoxy resin in the above-described embodiment. However, the impermeable coating 38 may be formed of other kinds of resin, such as one-pack epoxy resin and phenol resin, as long as the formed coating 38 is capable of preventing penetration of a cutting fluid into the core body 12. Where the cutting fluid is an oil or has a high content of oil component, it is preferable that the resin giving the coating 38 or the filler added to the resin has an excellent oilproof property.

Further, while the epoxy resin is applied onto the surface of the core body 12 by using the brush in the above-described embodiment, the application of the epoxy resin may be otherwise made, for example, by spraying the epoxy resin onto the core body 12, or by immersing the entirety of the core body 12 in a liquid of the epoxy resin.

Further, while glass fabrics 36 each formed of a multiplicity of glass yarns 34 are embedded in the annular core body 12 in the above-described embodiment, the multiplicity of glass yarns 34 may be simply embedded in the core body 12 without forming glass fabrics 36. In the latter case, it is preferable that each of the glass yarns 34 has a length of 1–5 mm, and is constituted by a total of about 100 fibers (each having a diameter of 9 μm) which are laid together.

Further, in the above-described embodiment, each of the gaps 26 is adapted to extend in the direction inclined or non-parallel with respect to the axis S1 of the core body 12. However, where the grinding operation is performed under a condition which is free from a risk of formation of chatter marks on the ground workpiece surface, each of the gaps 26 does not have to extend necessarily in the inclined direction, but may extend in a direction parallel with the axis S1 of the core body 12.

It is to be understood that the invention may be embodied with various other changes, modifications and improvements, which may occur to those skilled in the art, without departing from the sprit and scope of the invention defined in the following claims.

The invention claimed is:

1. A grinding wheel comprising:

an annular core body which includes a multiplicity of aggregate particles and a resin bond that holds said aggregate particles together;

an abrasive layer which is disposed radially outwardly of said annular core body and which includes a multiplicity of abrasive grains and a vitrified bond that holds said abrasive grains together; and an impermeable coating which is formed of a synthetic resin, and which covers a surface of said annular core body, over an entirety of said core body so that a portion of said impermeable coating disposed on an outer circumferential surface of said annular core body is interposed between said annular core body and said abrasive layer.

2. A grinding wheel according to claim 1, wherein said annular core body further includes at least one sheet of glass fabric each of which is provided by a multiplicity of glass yarns and each of which is embedded in said annular core body and extends perpendicularly to an axial direction of said annular core body.

3. A grinding wheel according to claim 2, wherein said at least one sheet of glass fabric consists of a plurality of sheets of glass fabric which are arranged in said axial direction of said annular core body.

4. A grinding wheel according to claim 1, wherein said abrasive layer is provided by a plurality of abrasive segment chips which are arranged in a circumferential direction of said annular core body and which are fixed to an outer circumferential surface of said annular core body.

5. A grinding wheel according to claim 4, wherein said plurality of abrasive segment chips includes at least one pair of segment chips having respective circumferential end faces which are circumferentially opposed to each other with a predetermined amount of gap therebetween and which are non-parallel with respect to an axial direction of said annular core body.

6. A grinding wheel according to claim 1, wherein said impermeable coating is formed of an epoxy resin.

7. A grinding wheel according to claim 1, wherein said impermeable coating is formed of a phenol resin.

8. A grinding wheel, comprising:

an annular core body which includes a multiplicity of aggregate particles and a resin bond that holds said aggregate particles together;

an abrasive layer which is disposed radially outwardly of said annular core body and which includes a multiplicity of abrasive grains and a vitrified bond that holds said abrasive grains together; and an impermeable coating which is formed of a synthetic resin, and which is disposed on a surface of said annular core body, wherein said annular core body is covered over an entirety thereof with said impermeable coating, so that a portion of said impermeable coating disposed on an outer circumferential surface of said annular core body is interposed between said annular core body and said abrasive layer.

* * * * *